US012428768B2

(12) United States Patent
Hu et al.

(10) Patent No.: US 12,428,768 B2
(45) Date of Patent: Sep. 30, 2025

(54) METHOD FOR DETECTING AND ADDRESSING DISCOLORED WATER ISSUES IN A WASHING MACHINE APPLIANCE

(71) Applicant: Haier US Appliance Solutions, Inc., Wilmington, DE (US)

(72) Inventors: Haitian Hu, Louisville, KY (US); Hairong Li, Louisville, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 507 days.

(21) Appl. No.: 17/824,232

(22) Filed: May 25, 2022

(65) Prior Publication Data

US 2023/0383455 A1 Nov. 30, 2023

(51) Int. Cl.

| | |
|---|---|
| ***D06F 34/22*** | (2020.01) |
| ***D06F 33/47*** | (2020.01) |
| *D06F 34/05* | (2020.01) |
| *D06F 103/20* | (2020.01) |

(52) U.S. Cl.

CPC ..... *D06F 34/22* (2020.02); *D06F 33/47* (2020.02); *D06F 34/05* (2020.02); *D06F 2103/20* (2020.02)

(58) Field of Classification Search

CPC ..... D06F 34/22; D06F 2103/20; D06F 33/47
See application file for complete search history.

(56) References Cited

U.S. PATENT DOCUMENTS

| | | | | |
|---|---|---|---|---|
| 2005/0050647 | A1 | 3/2005 | Tanaka et al. | |
| 2012/0174655 | A1 * | 7/2012 | Essich | G01N 3/18 73/53.01 |
| 2016/0076909 | A1 * | 3/2016 | Klicpera | G01F 15/0755 73/198 |
| 2019/0120809 | A1 | 4/2019 | Rexach et al. | |
| 2019/0264372 | A1 * | 8/2019 | Kessler | G01J 3/513 |

(Continued)

FOREIGN PATENT DOCUMENTS

| | | | |
|---|---|---|---|
| AU | 2020102377 | A4 * | 11/2020 |
| CN | 107794704 | B | 1/2020 |
| DE | 102015104452 | A1 * | 9/2016 |

(Continued)

OTHER PUBLICATIONS

Machine translation of WO-2018158209-A1, dated Sep. 7, 2018. (Year: 2018).*

*Primary Examiner* — Michael E Barr
*Assistant Examiner* — Kevin G Lee
(74) *Attorney, Agent, or Firm* — Dority & Manning, P.A.

(57) ABSTRACT

A washing machine appliance includes a wash tub positioned within a cabinet, a water inlet fluidly coupled to a water supply for receiving wash fluid, a wireless communication module, and a controller operably coupled to the wireless communication module. The controller is configured to obtain an event notification of a water discoloration event associated with the water supply and implement a responsive action in response to obtaining the event notification of the water discoloration event, such as stopping an operating cycle and providing the user with an issue rectification guide for mitigating effects of the water discoloration event.

17 Claims, 4 Drawing Sheets

(56) References Cited

U.S. PATENT DOCUMENTS

2022/0042504 A1* 2/2022 Ward ..... F04B 49/065

FOREIGN PATENT DOCUMENTS

| | | | | |
|---|---|---|---|---|
| KR | 20050066324 | A | 6/2005 | |
| KR | 20050066439 | A | 6/2005 | |
| WO | WO2016145719 | A1 | 9/2016 | |
| WO | WO-2018158209 | A1 * | 9/2018 | ..... G01N 21/25 |
| WO | WO2019179298 | A1 | 9/2019 | |

* cited by examiner

METHOD FOR DETECTING AND ADDRESSING DISCOLORED WATER ISSUES IN A WASHING MACHINE APPLIANCE

FIELD OF THE INVENTION

The present subject matter relates generally to washing machine appliances, and more particularly to methods for operating washing machine appliances during water discoloration events.

BACKGROUND OF THE INVENTION

Washing machine appliances generally include a cabinet that receives a tub for containing wash and rinse water. A wash basket is rotatably mounted within the tub. A drive assembly is coupled to the tub and configured to rotate the wash basket within the tub in order to cleanse articles within the wash basket. Upon completion of a wash cycle, a pump assembly can be used to rinse and drain soiled water to a draining system. Some washing machine appliances may also rotate the wash basket at a relatively high speed for a spin cycle to further drain or shed water from articles within the wash basket.

Notably, proper cleaning performance and user satisfaction with a washing machine appliance commonly assumes that the supply water provided for wash and/or rinse cycles is clear, clean water. However, if the supplied water is discolored or not clean for any reason, the user may be dissatisfied with the outcome of the wash cycle and the clothes may be discolored or ruined. These discolored water issues are not uncommon and may occur, for example, after a water main break or other water system maintenance work. Although discolored water caused by iron and manganese sediment has no health impact and it might be safe to drink, it has high risk of staining fabrics, especially light colors.

Accordingly, a washing machine appliance that is capable of preventing color contamination of clothes in the event of discolored water is desired. More specifically, a method of operating a washing machine appliance to detect discolored water and implementing corrective action would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a washing machine appliance is provided including a wash tub positioned within a cabinet, a wash basket rotatably mounted within the wash tub and defining a wash chamber configured for receiving a load of clothes, a water inlet fluidly coupled to a water supply for receiving wash fluid, a wireless communication module, and a controller operably coupled to the wireless communication module. The controller is configured to obtain an event notification of a water discoloration event associated with the water supply and implement a responsive action in response to obtaining the event notification of the water discoloration event.

In another exemplary embodiment, a method of operating an appliance during a water discoloration event is provided. The method includes obtaining an event notification of the water discoloration event associated with a water supply providing water to the appliance and implementing a responsive action in response to obtaining the event notification of the water discoloration event.

In yet another exemplary embodiment, an appliance is provided including a cabinet, a water inlet fluidly coupled to a water supply, a wireless communication module, and a controller operably coupled to the wireless communication module. The controller is configured to obtain an event notification of a water discoloration event associated with the water supply and implement a responsive action in response to obtaining the event notification of the water discoloration event.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
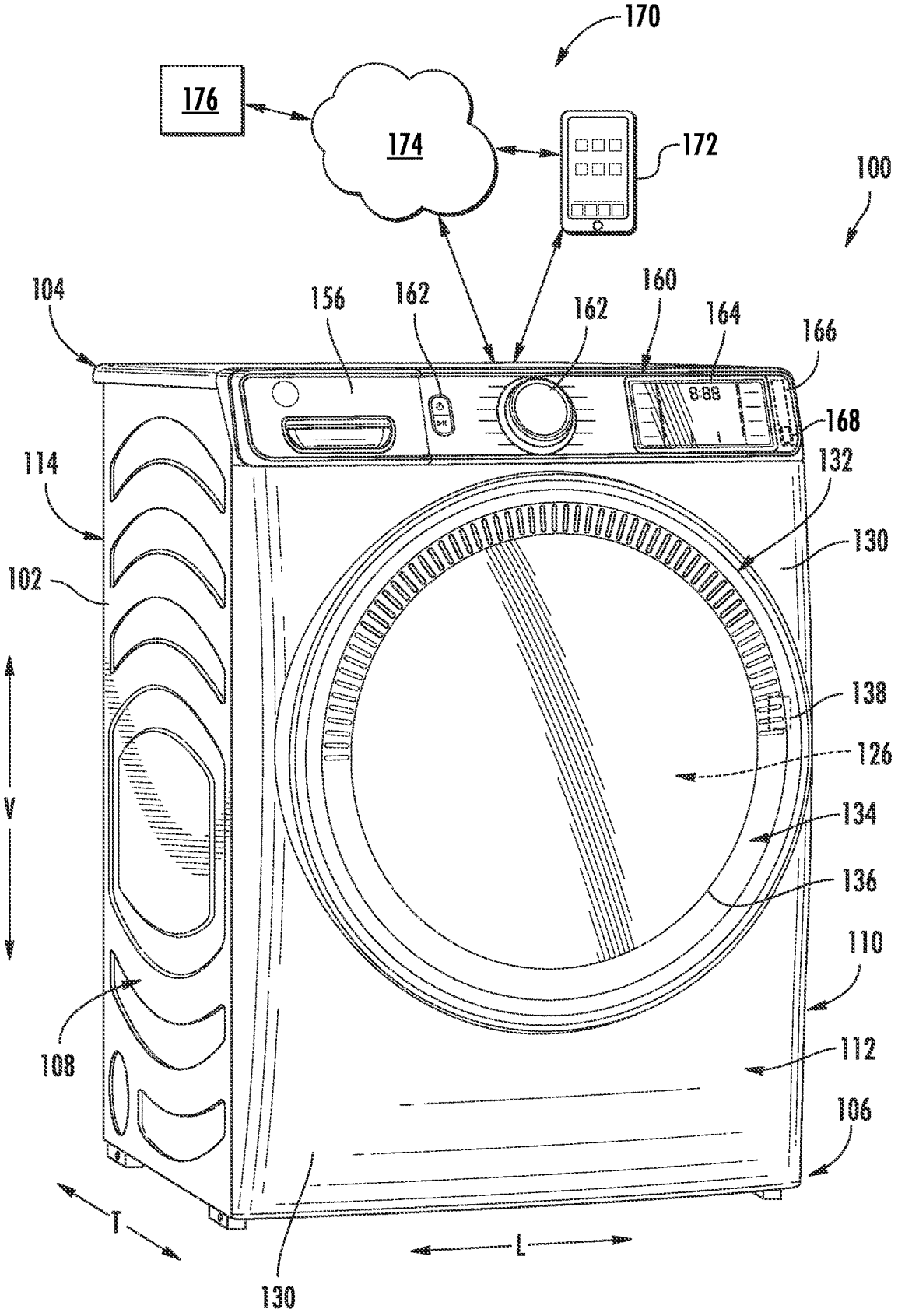
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
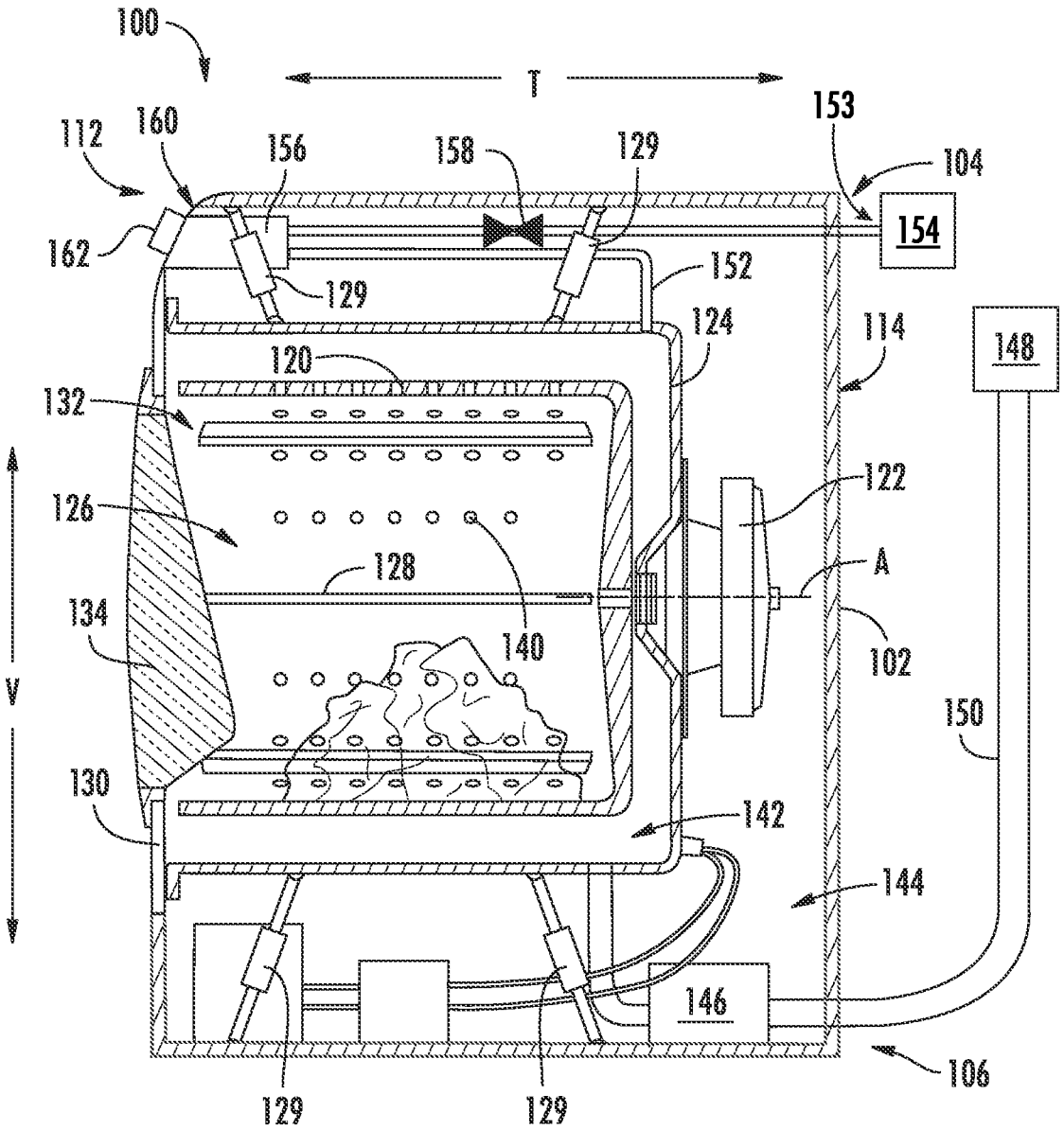
FIG. 2 provides a side cross-sectional view of the exemplary washing machine appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined.

According to exemplary embodiments, washing machine appliance 100 includes a cabinet 102 that is generally configured for containing and/or supporting various components of washing machine appliance 100 and which may also define one or more internal chambers or compartments of washing machine appliance 100. In this regard, as used herein, the terms "cabinet," "housing," and the like are generally intended to refer to an outer frame or support structure for washing machine appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of washing machine appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along the vertical direction V, between a first side 108 (e.g., the left side when viewed from the front as in FIG. 1) and a second side 110 (e.g., the right side when viewed from the front as in FIG. 1) along the lateral direction L, and between a front 112 and a rear 114 along the transverse direction T. In general, terms such as "left," "right," "front," "rear," "top," or "bottom" are used with reference to the perspective of a user accessing washing machine appliance 100.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

According to exemplary embodiments, wash tub 124 may be generally suspended within cabinet 102 by one or more suspension assemblies 129, e.g., as shown for example in FIG. 2. In this regard, wash tub 124, wash basket 120, motor 122, and other components of washing machine appliance 100 may be referred to generally herein as the subwasher. In order to reduce the transmission of vibrations and other forces from the subwasher to the cabinet 102 during operation of washing machine appliance 100, wash tub 124 may be generally isolated from cabinet 102 by suspension assemblies 129. This may be desirable to prevent undesirable noise, vibrations, "walking" of the appliance, etc. It should be appreciated that suspension assemblies 129 may generally include any suitable number and combination of springs, dampers, or other energy absorbing mechanisms to reduce the transmission of forces between the subwasher and cabinet 102. Although exemplary suspensions assemblies 129 are illustrated herein, it should be appreciated that the number, type, and configuration of suspension assemblies 129 may vary while remaining within the scope of the present subject matter.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Washing machine appliance 100 may further include a latch assembly 138 (see FIG. 1) that is mounted to cabinet 102 and/or door 134 for selectively locking door 134 in the closed position and/or confirming that the door is in the closed position. Latch assembly 138 may be desirable, for example, to ensure only secured access to wash chamber 126 or to otherwise ensure and verify that door 134 is closed during certain operating cycles or events.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

Washing machine appliance 100 may further include a wash fluid dispenser that is generally configured for dispensing a flow of water, wash fluid, etc. into wash tub 124. For example, a spout 152 is configured for directing a flow of fluid into wash tub 124. For example, wash machine appliance 100 may include a water inlet 153 that is in fluid communication with a water supply 154 (FIG. 2) in order to direct fluid (e.g., clean water or wash fluid) into wash tub 124. In this regard, water inlet 153 may be a fluid supply conduit that provides fluid communication between water supply 154 and spout 152, e.g., detergent drawer 156. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

During operation of washing machine appliance 100, laundry items are loaded into wash basket 120 through opening 132, and washing operation is initiated through operator manipulation of one or more input selectors or using a remote device (see below). Wash tub 124 is filled with water, detergent, and/or other fluid additives, e.g., via spout 152 and/or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

Referring again to FIG. 1, washing machine appliance 100 may include a control panel 160 that may represent a general-purpose Input/Output ("GPIO") device or functional block for washing machine appliance 100. In some embodiments, control panel 160 may include or be in operative communication with one or more user input devices 162, such as one or more of a variety of digital, analog, electrical, mechanical, or electro-mechanical input devices including rotary dials, control knobs, push buttons, toggle switches, selector switches, and touch pads. Additionally, washing machine appliance 100 may include a display 164, such as a digital or analog display device generally configured to provide visual feedback regarding the operation of washing machine appliance 100. For example, display 164 may be provided on control panel 160 and may include one or more status lights, screens, or visible indicators. According to exemplary embodiments, user input devices 162 and display 164 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

Washing machine appliance 100 may further include or be in operative communication with a processing device or a controller 166 that may be generally configured to facilitate appliance operation. In this regard, control panel 160, user input devices 162, and display 164 may be in communication with controller 166 such that controller 166 may receive control inputs from user input devices 162, may display information using display 164, and may otherwise regulate operation of washing machine appliance 100. For example, signals generated by controller 166 may operate washing machine appliance 100, including any or all system components, subsystems, or interconnected devices, in response to the position of user input devices 162 and other control commands. Control panel 160 and other components of washing machine appliance 100 may be in communication with controller 166 via, for example, one or more signal lines or shared communication busses. In this manner, Input/Output ("I/O") signals may be routed between controller 166 and various operational components of washing machine appliance 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 166 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 166 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 166 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 166 as disclosed herein is capable of and may be operable to perform any methods, method steps, or portions of methods of appliance operation. For example, in some embodiments, these methods may be embodied in programming instructions stored in the memory and executed by controller 166.

The memory devices may also store data that can be retrieved, manipulated, created, or stored by the one or more processors or portions of controller 166. The data can include, for instance, data to facilitate performance of methods described herein. The data can be stored locally (e.g., on controller 166) in one or more databases and/or may be split up so that the data is stored in multiple locations. In addition, or alternatively, the one or more database(s) can be connected to controller 166 through any suitable network(s), such as through a high bandwidth local area network (LAN) or wide area network (WAN). In this regard, for example, controller 166 may include a wireless communication module 168 (FIG. 1) that generally establishes wireless communications between controller 166 of washing machine appliance 100 and external communication system or a network. Controller 166 may further include any other suitable communication modules or interfaces that may be used to communicate with one or more other component(s) of washing machine appliance 100, controller 166, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Referring again to FIG. 1, a schematic diagram of an external communication system 170 will be described according to an exemplary embodiment of the present subject matter. In general, external communication system 170 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 170 may be used to transfer data or other information to improve performance of one or more external devices or appliances and/or improve user interaction with such devices.

For example, external communication system 170 permits controller 166 of washing machine appliance 100 to communicate with a separate device external to washing machine appliance 100, referred to generally herein as an external device 172. As described in more detail below, these communications may be facilitated using a wired or wireless connection, such as via a network 174. In general, external device 172 may be any suitable device separate from washing machine appliance 100 that is configured to provide and/or receive communications, information, data, or commands from a user. In this regard, external device 172 may be, for example, a personal phone, a smartphone, a tablet, a laptop or personal computer, a wearable device, a smart home system, or another mobile or remote device.

In addition, a remote server 176 may be in communication with washing machine appliance 100 and/or external device 172 through network 174. In this regard, for example, remote server 176 may be a cloud-based server 176, and is thus located at a distant location, such as in a separate state, country, etc. According to an exemplary embodiment, external device 172 may communicate with a remote server 176 over network 174, such as the Internet, to transmit/receive data or information, provide user inputs, receive user notifications or instructions, interact with or control washing machine appliance 100, etc. In addition, external device 172 and remote server 176 may communicate with washing machine appliance 100 to communicate similar information.

In general, communication between washing machine appliance 100, external device 172, remote server 176, and/or other user devices or appliances may be carried using any type of wired or wireless connection and using any suitable type of communication network, non-limiting examples of which are provided below. For example, external device 172 may be in direct or indirect communication with washing machine appliance 100 through any suitable wired or wireless communication connections or interfaces, such as network 174. For example, network 174 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances. Indeed, aspects of the methods described below may be applicable to the operation of any suitable appliance.

Now that the construction of washing machine appliance 100 and the configuration of controller 166 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as vertical axis washing machine appliances. In exemplary embodiments, the various method steps as disclosed herein may be performed by controller 166 or a separate, dedicated controller.

In addition, according to exemplary embodiments, aspects of the present subject matter may be applicable to any appliance that receives water from a water supply. In this regard, although method 200 is described with respect to washing machine appliance 100, it should be appreciated that water discoloration events may affect the operation of various other appliances, such as refrigerator appliances, ice making appliances, hot water heaters, dishwashers, etc. For example, method 200 may be used to prevent the dispensing of discolored water for consumption by a user through a refrigerator appliance dispenser, may prevent the formation of ice using discolored water, etc. Other applications of method 200 are possible and within the scope of the present subject matter.

Figure 3:
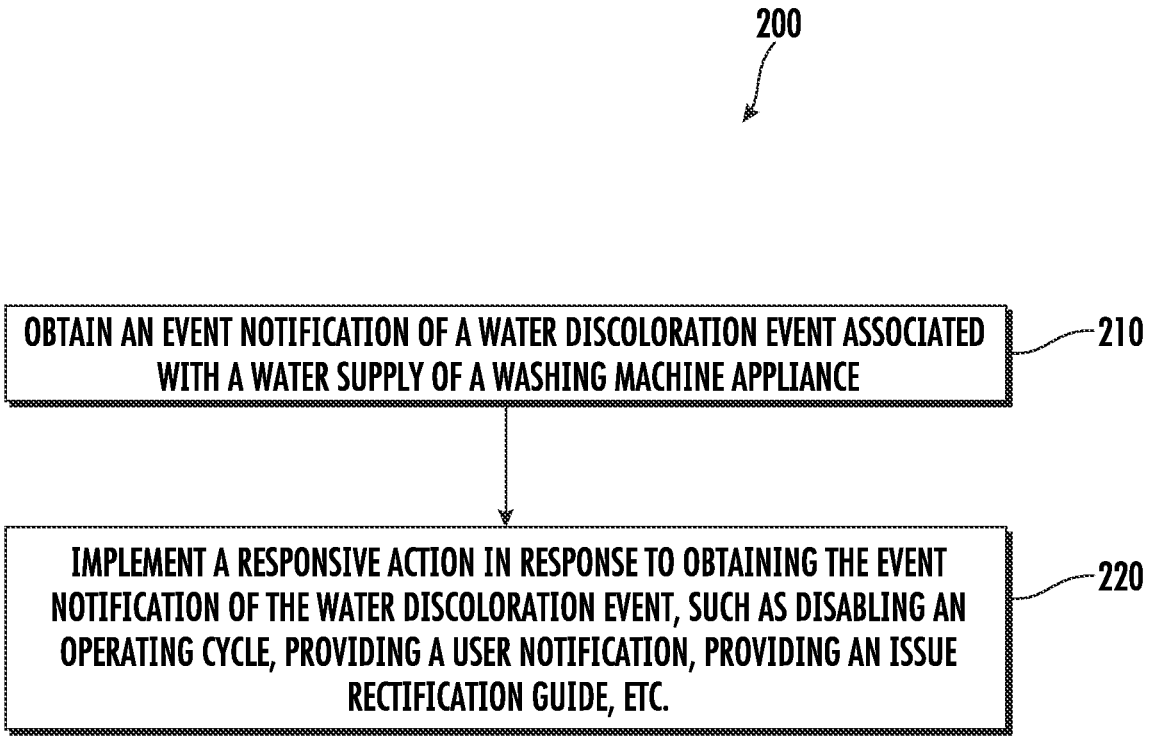
FIG. 3 illustrates a method of operating a washing machine appliance when water discoloration events occur according to an exemplary embodiment of the present subject matter.

Referring now to FIG. 3, method 200 includes, at step 210, obtaining an event notification of a water discoloration event associated with a water supply of a washing machine appliance. In this regard, for example, water supply 154 may be a municipal water supply connected to washing machine appliance 100 through water inlet 153. It is not uncommon for such a water supply 154 to be contaminated or otherwise provide discolored water, e.g., during certain situations such as a busted pipe, water main repair, etc. Such a situation may be referred to herein generally as a water discoloration event, and such an event may present the risk of staining clothes or otherwise deteriorating the performance of washing machine appliance 100. Accordingly, step 210 includes obtaining an event notification such that corrective action may be taken.

In general, the event notification may be obtained from any suitable source and in any suitable manner. In this regard, for example, the event notification may be obtained through a network using a wireless communication module (e.g., such as wireless communication module 168 and network 174). In this regard, network 174 may include or be in operative communication with a remote server 176 that includes a search engine that continuously monitors water quality situations through various sources.

Figure 4:
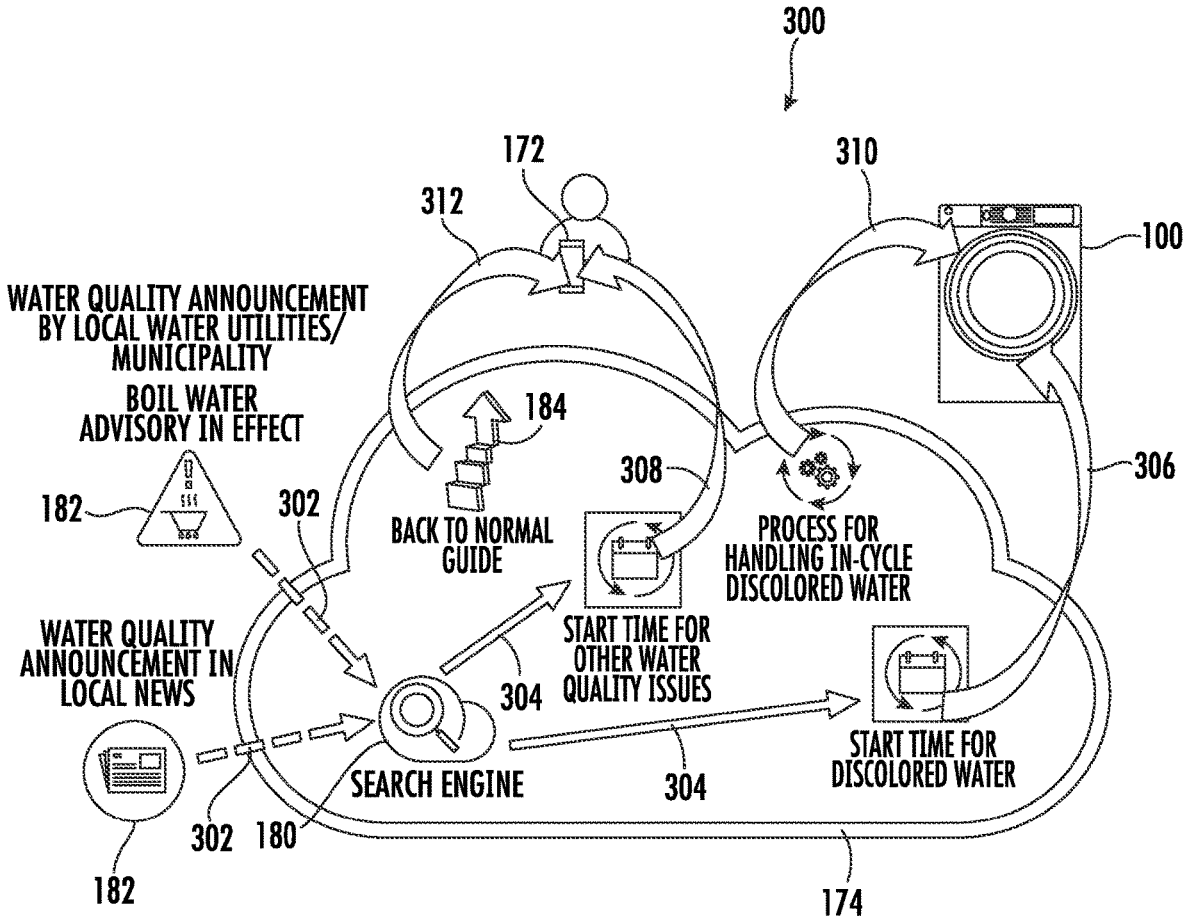
FIG. 4 provides a schematic view of a system and method for detecting and mitigating the effects of water discoloration events according to an exemplary embodiment of the present subject matter.

For example, referring briefly to FIG. 4, a search engine 180 may be located on network 174 and may continuously or periodically monitor news and announcements from local water utilities, local municipalities, or other news sources (identified generally by reference numeral 182). In this regard, for example, if a ruptured pipe results in contaminated and discolored water within a given water supply, the source of the water supply (e.g., such as a local municipality) may provide a boil water advisory or another notification of such water contamination. In addition, this water discoloration event may be communicated in the local news and information regarding this water discoloration event may be obtained by search engine 180.

According to still other embodiments, the event notification of the water discoloration event that is obtained at step 210 may be obtained from a user of the washing machine appliance. In this regard, for example, the user of washing machine appliance 100 may obtain knowledge of a water discoloration event from news sources 182 or directly through use of water in the location where washing machine appliance 100 is installed. For example, if the user of washing machine appliance 100 uses a local faucet to dispense water and notices discoloration, the user may notify washing machine appliance 100 such that corrective action may be taken.

It should be appreciated that the user may communicate this event notification in any suitable manner. For example, the user may interact directly with washing machine appliance 100 via control panel 160. By contrast, according to alternative embodiments, a user may utilize a remote device 172 to communicate with washing machine appliance wirelessly over external communication system 170 or through direct wireless communication with wireless communication module 168. For example, a user may have an appliance software application downloaded on their mobile phone that permits interaction and communication with washing machine appliance 100. When a water discoloration event is detected by the user, the user may open the software application and input data related to the water discoloration event (e.g., such as start and end times).

In general, the event notification may include any data related to the water discoloration event that may be useful in implementing corrective action and reducing the likelihood of color contamination issues associated with discolored water. For example, the event notification may include an anticipated start time, an anticipated end time, and/or the cause of the water discoloration event. The event notification may further include recommended corrective action that may be used to mitigate issues associated with the water discoloration event.

Referring again to FIG. 3, step 220 includes implementing a responsive action in response to obtaining the event notification of the water discoloration event. In this regard, the responsive action may generally include any suitable actions taken by washing machine appliance 100, by the water supply source 154, by the user of washing machine appliance, or by any other entity that are intended to rectify the water discoloration event and/or mitigate the effects of such an event.

For example, according to an exemplary embodiment, implementing the responsive action may include disabling operating cycles of washing machine appliance 100 prior to the start time of the water discoloration event. For example, if a user is attempting to perform a wash cycle or a rinse cycle using washing machine appliance 100 and the performance of such cycle may utilize water contaminated during the water discoloration event, controller 166 may automatically disable the performance of such a cycle that may notify the user of the reasons for doing so.

In addition, according to alternative embodiments, implementing the responsive action may include adjusting any other suitable operating parameter of washing machine appliance. For example, washing machine appliance 100 may adjust a temperature of the flow of wash fluid, may adjust the volume of supplied wash fluid, may adjust a detergent concentration of the wash fluid, etc. In addition, method 200 may include performing rectification steps in the event a water discoloration event occurs in the middle of an operating cycle. In this regard, method 200 may include determining that the washing machine appliance is performing an operating cycle when the water discoloration event occurs and pausing the operating cycle until fresh wash fluid is available. This availability of fresh wash fluid may be included in the event notification, may be provided by the user, or may be determined in any other suitable manner.

According to exemplary embodiments, step 220 of implementing a responsive action may further include providing a user notification of the event notification and/or details regarding the water discoloration event. For example, this user notification may be provided via control panel 160, e.g., through communications on display 164. According to still other embodiments, the user notification may be provided directly to the user through a remote device 172 (e.g., such as through a software application on the user's cell phone) over network 174. According to exemplary embodiments, this user notification may provide a user with details related to the water discoloration event, such as start time, end time, cause, etc.

In addition, according to exemplary embodiments, the user notification may include an issue rectification guide (e.g., identified generally in FIG. 4 by reference numeral 184) for mitigating effects of the water discoloration event. In this regard, the issue rectification guide 184 may inform the user as to the appropriate manner for stopping the water discoloration event or otherwise clearing discolored water from the water supply. For example, the issue rectification guide 184 may be presented to the user through control panel 160 or through remote device 172. This guide 184 may provide the user with step-by-step instructions, such as opening a faucet at a lowest level of the residence after the end time of the water discoloration event and allowing water to flush for a predetermined amount of time or until the water runs clear. Other mitigation steps are possible and within the scope of the present subject matter.

According to exemplary embodiments, implementing the responsive action may further include seeking a user confirmation that the water discoloration event has passed and fresh water is being supplied before enabling subsequent operating cycles. For example, method 200 may include requesting, at the end time of the water discoloration event, a user confirmation that the wash fluid supplied from the water supply is no longer discolored. In this regard, the user may visually inspect the supplied water or sample the water supplied from water supply 154 and may confirm (e.g., via control panel 160 or remote device 172) that the water discoloration issues have been resolved. In addition, or alternatively, method 200 may include requesting, at the end time of the water discoloration event, a user confirmation that event mitigation steps have been performed. After the user confirms that appropriate action has been taken and the water discoloration event should no longer affect the performance of washing machine appliance 100, appliance operation may continue as normal.

Referring now briefly to FIG. 4, an exemplary system and flow diagram of a method 300 for detecting and mitigating the effects of water discoloration events associated with a washing machine appliance will be described according to an exemplary embodiment of the present subject matter. Although illustrated as being performed with washing machine appliance 100, it should be appreciated that method 300 may be used to detect and mitigate water discoloration events for any appliance, faucet, or water supply device that uses water. According to exemplary embodiments, portions of method 300 may be the same or interchangeable with steps of method 200.

As illustrated, step 302 generally includes obtaining an event notification and data related to a water discoloration event from an external source or the user. In this regard, as shown in FIG. 4, search engine 180 obtains such information from news sources 182. At step 304, useful information may be extracted and analyzed from the event notification, such as the start time when discolored water may be supplied to the washing machine appliance 100. At step 306, this start time and other useful information related to the water discoloration event may be transmitted to the washing machine appliance 100 (e.g., via wireless communication module 168). In addition, notification of the start time of other water quality issues arising from the water discoloration event may be communication to the user at step 308.

Method 300 may further include, at step 310, communicating a process or otherwise instructing an appliance as to a process for handling the water discoloration event. For example, step 310 may include commands to disable the washing machine appliance 100 prior to the water discoloration event and only enable operating cycles after corrective action or mitigating steps have been performed. Step 312 may further include communicating to the user of the appliance (e.g., via remote device 172) steps that should be taken to mitigate the effects of the water discoloration event, e.g., as described above.

FIGS. 3 and 4 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 and method 300 are explained using washing machine appliance 100 as an example, it should be appreciated that this method may be applied to the operation of any suitable appliance, such as another washing machine appliance, a refrigerator appliance, a kitchen faucet, etc.

As explained herein, aspects of the present subject matter are generally directed to a cloud-based system for handling discolored water for a clothes washer. In this regard, discolored water issues generally happen after a water main break or other water system maintenance work. The discolored water caused by iron and manganese sediment presents a high risk of staining fabrics, especially light color fabrics. Conventional washing machine appliances do not have systems to handle discolored water issues, particularly when presented in middle of a washing cycle. In order to overcome the aforementioned problems, an automatic cloud-based system for handling the discolored water is proposed that minimizes the risk of discolored water for clothes washing and provides step-by-step back to normal guide after discolored water.

In the present invention, a cloud-based water quality search engine may monitor announcements by user's local water utilities, municipality, and news services online and the start time of an announced water quality issue may be saved in cloud by the search engine. The clothes washer may be disabled before the start time of the announced water quality issue and the user may get a notification that the washer has been disabled until the water is clear again. For other water quality issues, the user may receive a notification to keep an eye on the water for possible discolored water issues. If discolored water is discovered, the user may have the option to notify the system through the mobile device application. Further, if discolored water is discovered in the middle of the washing cycle, the system can stop the washing cycle and wait until clean water is available to finish, i.e., the system may not allow the washer to empty the water and go into a spin cycle. After the clean water is back, the user may flush the plumbing in a whole house correctly based on step-by-step guidance from the system. The system also may also take inputs from the user to get the disabled washer back to normal. This system and method thereby give the user peace of mind and significantly reduce the risk of discolored water damage to clothes.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
- a wash tub positioned within a cabinet;
- a wash basket rotatably mounted within the wash tub and defining a wash chamber configured for receiving a load of clothes;
- a water inlet fluidly coupled to a water supply for receiving wash fluid;
- a wireless communication module; and
- a controller operably coupled to the wireless communication module, the controller being configured to:
  - obtain an event notification of a water discoloration event associated with the water supply;
  - implement a responsive action in response to obtaining the event notification of the water discoloration event; and
  - request, at an end time of the water discoloration event, a user confirmation that either the wash fluid supplied from the water supply is no longer discolored or that event mitigation steps have been performed.

2. The washing machine appliance of claim 1, wherein the event notification of the water discoloration event is obtained from a network using the wireless communication module.

3. The washing machine appliance of claim 1, wherein the event notification is obtained from at least one of a local water utility, a municipality, or a news source.

4. The washing machine appliance of claim 1, wherein the event notification of the water discoloration event is obtained from a user of the washing machine appliance.

5. The washing machine appliance of claim 4, wherein the user provides the event notification of the water discoloration event using a software application on a remote device.

6. The washing machine appliance of claim 1, wherein the event notification comprises a start time of the water discoloration event, and wherein implementing the responsive action comprises disabling an operating cycle of the washing machine appliance prior to the start time of the water discoloration event.

7. The washing machine appliance of claim 1, wherein implementing the responsive action comprises providing a user notification of the water discoloration event.

8. The washing machine appliance of claim 7, wherein the user notification comprises an issue rectification guide for mitigating effects of the water discoloration event.

9. The washing machine appliance of claim 7, wherein the user notification is provided using a user interface of the washing machine appliance or a remote device.

10. The washing machine appliance of claim 1, wherein implementing the responsive action comprises adjusting at least one operating parameter of the washing machine appliance.

11. The washing machine appliance of claim 1, wherein the controller is further configured to:
- determine that the washing machine appliance is performing an operating cycle when the water discoloration event occurs; and
- pause the operating cycle until fresh wash fluid is available.

12. The washing machine appliance of claim 1, wherein the event notification is received from a search engine located on a remote server.

13. A method of operating an appliance during a water discoloration event, the method comprising:

obtaining an event notification of the water discoloration event associated with a water supply providing water to the appliance; and implementing a responsive action in response to obtaining the event notification of the water discoloration event, wherein the responsive action comprises requesting, at an end time of the water discoloration, a user confirmation that either the wash fluid supplied from the water supply is no longer discolored or that event mitigation steps have been performed.

14. The method of claim 13, wherein the event notification of the water discoloration event is obtained from a network through at least one of a local water utility, a municipality, or a news source.

15. The method of claim 13, wherein the event notification of the water discoloration event is obtained from a user of the appliance.

16. The method of claim 13, wherein the event notification comprises a start time of the water discoloration event, and wherein implementing the responsive action comprises disabling an operating cycle of the appliance prior to the start time of the water discoloration event.

17. The method of claim 13, wherein implementing the responsive action comprises providing a user notification of the water discoloration event, wherein the user notification comprises an issue rectification guide for mitigating effects of the water discoloration event.

* * * * *